United States Patent [19]

Toman

[11] 4,129,872

[45] Dec. 12, 1978

[54] MICROWAVE RADIATING ELEMENT AND ANTENNA ARRAY INCLUDING LINEAR PHASE SHIFT PROGRESSION ANGULAR TILT

[75] Inventor: Donald J. Toman, Pleasantville, N.Y.

[73] Assignee: Tull Aviation Corporation, Kansas City, Mo.

[21] Appl. No.: 738,659

[22] Filed: Nov. 4, 1976

[51] Int. Cl.[2] ..... H01Q 13/10; H01Q 19/14

[52] U.S. Cl. ..... 343/768; 343/771; 343/840

[58] Field of Search ..... 343/768, 771, 783, 854, 343/840

[56] References Cited

U.S. PATENT DOCUMENTS 2,433,368 12/1947 Johnson et al. ..... 343/786

2,605,413 7/1952 Alvarez ..... 343/854

3,931,624 1/1976 Hundley et al. ..... 343/768

*Primary Examiner*—Alfred E. Smith

*Assistant Examiner*—David K. Moore

*Attorney, Agent, or Firm*—Curtis Ailes

[57] ABSTRACT

A slotted waveguide radiator for an antenna array is arranged to receive microwave energy inputs at either end for producing separate radiated beams and has loading slots having predetermined center-to-center spacings in the longitudinal dimension to provide a predetermined squint angle for each radiated beam which is related to the direction in which energy is fed to the waveguide. The radiator includes means for providing a linear phase shift progression in the signal components radiated from the slots from one end of the waveguide to the other to thereby provide an angular tilt to each radiated beam which is independent of the direction in which energy is fed to the waveguide.

23 Claims, 5 Drawing Figures

MICROWAVE RADIATING ELEMENT AND ANTENNA ARRAY INCLUDING LINEAR PHASE SHIFT PROGRESSION ANGULAR TILT

The invention relates to microwave radiating elements and antenna arrays which are particularly useful for radiating directional beams of microwave energy to provide a desired pattern of beams. Such radiations are useful in microwave guidance systems for aircraft, such as, for instance, microwave instrument landing systems.

The present invention is especially useful for microwave aircraft guidance systems such as the system disclosed for instance in U.S. Pat. No. 3,931,624 issued Jan. 6, 1976 to Warren Hundley and Michael A. Eovine for AN ANTENNA ARRAY FOR AIRCRAFT GUIDANCE SYSTEM. The present invention is especially useful in a structure similar to that disclosed in the above-mentioned prior patent, and the present invention is specifically disclosed in conjunction with, and by reference to, the disclosures of that prior patent.

In systems such as that illustrated in the prior patent, which call for the radiation of an array of directional microwave beams, it is generally desirable to provide for a common line of focus for all of the radiating elements which radiate the different beams in order to provide for uniformity in the shaping of beams in the dimension transverse to the line of focus. This is particularly true in connection with a system such as that disclosed in the prior patent which employs a cylindrical reflector which is arranged generally parallel to the line of focus of the radiating elements, the shape of the reflector being used to determine the shapes of all of the beams in a dimension transverse to the line of focus. In the prior patent that transverse dimension is the vertical dimension, the line of focus, and the cylindrical reflector, generally being arranged horizontally. In the system of the prior patent, the reflector is preferably a parabolic reflector, and the line defining the positions of the radiating elements is preferably positioned near the line of focus of the parabolic reflector.

In accordance with the teachings of the prior patent, the radiating elements are preferably, for the most part, slotted waveguides which are arranged to be driven alternatively from either end for the production of two different beams from each waveguide. The waveguides are designed to impart a predetermined squint angle to the radiated beams which is dependent upon the direction of energy transmission through the waveguide. Thus, the two beams radiated from each waveguide are squinted in opposite directions. Each waveguide radiating element is then used to radiate a pair of beams, and the respective members of each pair are on opposite sides of the guidance plane defined by the beams and the modulations carried by the beams. However, since the radiating elements must be arranged along one line of radiation, there is necessarily a certain amount of parallax error introduced by having the pairs of beams which are equally spaced on opposite sides of the guidance plane radiated from different transverse positions along the line of focus. Accordingly, it is one object of the present invention to reduce the parallax errors provided in such an antenna array.

It is another object of the present invention to provide reduced interference from various sources such as objects which are in the path of the radiated beams, by means of an improved space diversity effect as the different beams are radiated.

Further objects and advantages of the invention will be apparent from the following description and the accompanying drawings.

In carrying out the invention there may be provided a line source microwave radiation element for an antenna array for radiating two shaped beams at selected angles comprising a slotted waveguide arranged to receive signal inputs at either end and having loading slots arranged in the face of one wall thereof and spaced transversely with respect to the longitudinal axial centerline thereof to produce beams of a desired shape within a central plane containing said axial centerline, said loading slots having predetermined center-to-center spacings in the longitudinal dimension to provide a predetermined squint angle within said central plane for each radiated beam with respect to the plane of said slotted face and related to the direction in which energy is fed to the waveguide, and means for providing a linear phase shift progression in the signal components radiated from the slots from one end of said waveguide to the other to thereby provide a predetermined angular tilt to each radiated beam within said central plane which is independent of the direction in which energy is fed to the waveguide and which is algebraically added to said squint angle.

In another aspect, the invention may further provide an antenna array for radiating a pattern of angularly spaced microwave radio beams which are particularly useful for instrument guidance of aircraft comprising a first pair of slotted waveguide microwave signal radiating elements, each of said elements having loading slots in the face of one wall thereof and spaced transversely with respect to the longitudinal axial center line thereof to produce beams of a desired shape within a central plane containing said axial center line, said antenna array being operable as a switched scanning beam antenna array in which carrier energy is switched in a sequence from one beam to another, said radiating elements each including means for separately introducing signals at each end thereof, each of said radiating elements being designed with the positions of the slots in the slotted wall thereof arranged so as to provide radiation directed outwardly at predetermined angles referred to as squint angles of deviation away from a direction normal to the slotted face of the radiating element, said squint angles being dependent upon the direction of propagation of the signal through the waveguide so that oppositely disposed squint angles are provided when the radiation element is fed from opposite ends, said radiating elements being arranged end to end with said longitudinal axial center lines of said radiating elements being in mutual alignment and with said slotted faces of said radiating elements being mutually parallel so that the central plane of the individual beams produced by each of said radiating elements is a common central plane, said radiating elements of said first pair having equal squint angles, each of said radiating elements including means for providing a linear phase shift progression in the signal components radiated from the slots from one end of said element to the other to thereby provide a predetermined angular tilt to each beam within said central plane which is independent of the direction in which energy is fed to the element and which is algebraically added to the applicable squint angle, the phase shift progression angular tilt for one of said radiating elements of said first pair being opposite to the shift phase progression angular tilt for the other one of said radiating elements of said first pair and the combinations of squint angles and phase shift progression angular tilts being selected to provide four beams from said radiating elements which are at four different selected angles within said central plane.

The term "phase shift progression" is often abbreviated below to "phase progression."

In the accompanying drawings

Figure 1:
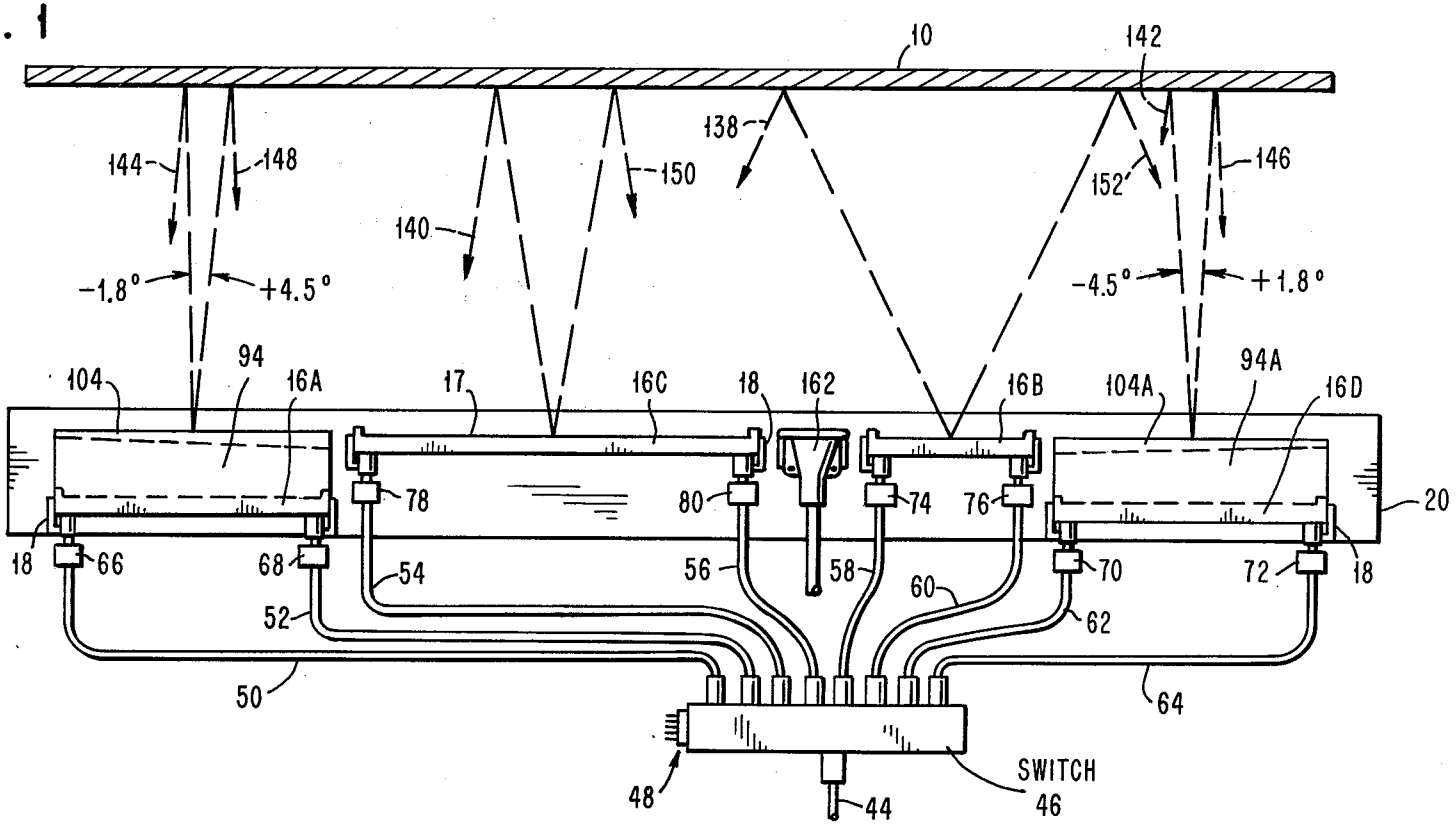
FIG. 1 is a plan view, which is partly schematic and partly in section, of an antenna array in accordance with the invention which includes a common reflector structure and illustrates the preferred relative positions of the radiating elements.

Referring more particularly to FIG. 1, there is shown a simplified plan view of an antenna array, partly schematic, and partly in section, in accordance with the present invention. The array includes a cylindrical reflector 10, shown in section, and illustrated only at the section plane for simplicity and clarity. The antenna array also includes a plurality of radiating elements 16A–16D which radiate beams of microwave energy from slotted faces 17 to the reflector 10 as indicated by the various dotted lines 138, 140–152.

The slotted waveguides 16A–16D, which are also referred to herein as radiating elements, are supported by means of suitable individual supporting brackets 18 upon a common mounting plate 20 for all of the waveguides. The mounting plate 20 is preferably attached to and supported by a support structure which is common to the reflector 10. Thus, the positions of the slotted waveguides 16A–16D are fixed with relation to the reflector 10. Details of a suitable mechanical structure for this purpose are shown in the above-mentioned prior patent in connection with a side elevation view. The waveguides 16A–16D are designed to provide separate radiation component beams 138, 140–152 at different azimuth angles. However, the beams are preferably substantially identical in the elevation aspect (in the dimension substantially transverse to the plane of the drawing, and transverse to the common mounting axis of the radiating elements 16A–16D). The common line of the radiation apertures of the radiating elements 16A–16D is parallel to the reflector 10, and generally parallel to all positions of the generatrix defining the cylindrical shape of the cylindrical reflector 10. The common line of radiation apertures of the radiating elements 16A–16D is preferably at, or near, the focus of the parabolic cylindrical reflector 10.

Each of the slotted waveguide radiating elements is preferably capable of being fed from each end with a separate switched beam signal. The spacing of the slots in each waveguide is arranged to provide a desired angular deviation of the beam of microwave energy away from a direction normal to the slotted face of the waveguide. This is referred to as a "squint" angle. The direction of the squint angle depends upon which end of the waveguide is driven. Accordingly, by driving each waveguide alternately from either end, two separate beams are obtainable from each slotted waveguide symmetrically oriented on opposite sides of the normal to the slotted face of the waveguide. This avoids the need for providing a separate slotted waveguide for each beam, and thus reduces the over-all size and cost of the apparatus.

In accordance with the present invention, each of the waveguides 16A and 16D is additionally provided with a means for providing a linear phase shift progression angular tilt to each radiated beam, as described more fully below.

The incoming energy from a microwave transmitter is applied at 44 to a microwave switch device 46. The microwave switch device 46 operates in response to switching control signals received at 48 to distribute the microwave energy in a switching sequence to the various coaxial feed lines 50–64. The coaxial feed lines 50–64 are connected to the waveguides through isolators 66–80. Each isolator permits the signal from the associated coaxial cable to be transmitted through to the associated end of the associated waveguide, but the isolator acts as a non-reflective load with respect to any part of the signal fed to the opposite end of the waveguide which is not completely radiated and dissipated by the coupling of energy provided by the slots in the face of the waveguide. Thus, the isolator 78 permits the signal from the associated coaxial cable 54 to be coupled through to the inside of the left end of the slotted waveguide radiator 16C for the generation of a microwave beam 140, but the isolator 70 operates as a non-reflective load for the signal supplied from the coaxial cable 54 so that the signal is not coupled back through the coaxial cable 56, and it is not reflected from the right end of the waveguide 16C. Similarly, the signal on coaxial cable 56 is permitted to pass through the isolator 80 for coupling to the right end of the waveguide 16C to generate a beam 150, and any undissipated energy from that source is absorbed by the isolator 78. In similar fashion, the signal applied to each end of each waveguide is operable completely independent of the signal applied to the opposite end of that waveguide to produce an independent microwave beam.

The various beams of microwave energy emitted by the slotted waveguide radiators are graphically shown by dotted lines representing the center lines of individual beams, and illustrating how the beams are emitted by the slotted waveguides and reflected from the reflector 10. Thus, waveguide 16A emits the beams respectively represented by the center lines 144 and 148, waveguide 16B emits beams 138 and 152, waveguide 16C emits beams 140 and 150, and waveguide 16D emits beams 142 and 146.

The numbers applied to the individual beams in the immediately preceding passage are arranged in an order such that the beam 138 which is deflected the farthest to the left is represented by the lowest number, and the beam 152 deflected the farthest to the right is represented by the highest number, and the others are all numbered according to their alignment in terms of angle of deflection to the left and then to the right.

Most of the waveguides 16–16C are designed with the slots spaced so as to provide a "backward" squint of the radiated beam. This means that the beam resulting from a signal supplied to a particular end of a waveguide is deflected away from a direction normal to the face of that waveguide toward the end which is being fed. Thus, the signal on coaxial cable 54 supplied to the left end of waveguide 16C results in the beam 140, and the signal from coaxial cable 56 results in the beam 150. It is possible to design the slotted waveguides to have any desired squint angle, within reasonable limits, including forward squint angles as well as backward squint angles. However, in one physical embodiment, it has been found that the backward squint designs produce lower undesired side-lobe radiations, particularly where larger squint angles are required.

The navigation plane defined by the system is a plane which is normal to each of the waveguides 16A–16D, and which theoretically should intersect with the transverse center line of each of the waveguides. Thus, ideally, the waveguides should issue their individual beams from a common transverse center line. However, this is not possible when the waveguides are to be positioned on a common horizontal line parallel to the reflector in order to provide uniform beam elevation patterns. But it has been found that, since the separation of the transverse center lines of the separate waveguides is very small in relation to the dimensions of the signal field, for practical purposes a single navigational plane is defined by the system. As described more fully below, the present invention reduces the parallax error which arises from the separation of the transverse center lines of the separate waveguides.

In a preferred embodiment, with the eight beam array represented in FIG. 1, the combination of the squint angle and the linear phase shift progression angular tilt to each radiated beam for each of the radiators 16A and 16D is such as to provide beams 142 and 144 which are the closest to the navigational plane at 1.8°, and the next wider spaced beams 142 and 148, which are each 4.5° from the navigational plane. Thus, the beams 144 and 146 are 3.6° apart, and the beams 142 and 148 are 9° apart. The squint angle for radiator 16C, which emits the next wider spaced beams 140 and 150, is 9°, thus providing an angular spacing between beam 140 and beam 142 of 4.5°. Finally, the beams having the widest spacing, sometimes referred to herein as the "cover" beams 138 and 152 are emitted from waveguide radiating element 16B at a squint angle of 26°.

The beams 142, 144, 138 and 140 which are angled to the left in the drawing are modulated with a predominance of 90 Hz modulation frequency. The beams 148, 146, 152 and 150 which are angled to the right are modulated with a predominance of 150 Hz modulating frequency. The receiver in the aircraft determines when the 150 Hz and 90 Hz signals are equal to thereby determine when the aircraft is in the guidance plane. If the aircraft is to the left of the guidance plane, the 90 Hz modulation predominates, telling the aircraft to fly right in order to get to the guidance plane. Similarly, if the aircraft receives a predominance of 150 Hz modulated signals, it is told to fly left. Thus, the guidance plane is defined by the balance of the modulating signals. In the arrangement illustrated, and with the specific angles enumerated, the cover beams 138 and 152 are intended to be relatively wide beams, and since they are emitted at a wide angle, they provide a correct signal to an aircraft which is substantially off course. However, the other beams are narrow beams and are at narrower angular spacings to provide a very accurate indication to the aircraft as it approaches the guidance plane. It will be understood that the specific beam angles given are those which have been found useful and are preferred in a particular physical embodiment. However, these angles, as well as other specific constants given in this disclosure may be varied and adjusted without departing from the spirit of the invention.

A wide angle horn antenna radiator 162 may be provided and mounted upon the common mounting plate 20 for directing a wide angle beam to the reflector 10 for transmission to the vehicle being guided, the beam signal being a standard reference frequency signal for stabilizing and enhancing the discrimination of the aircraft receiver. The elevation pattern of this beam is similar to the elevation patterns of the beams from the waveguides.

In a preferred physical embodiment of the apparatus, the reflector 10 is in the order of 3.2 meters in width, and the mounting plate 20 has a width equal to the width of the reflector.

Figure 2:
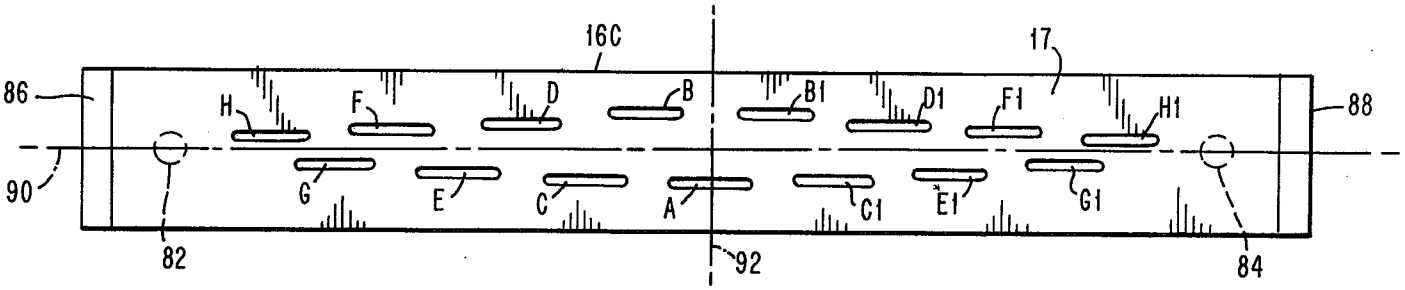
FIG. 2 is a face view of the slotted face of a slotted waveguide radiating element employed in the embodiment of FIG. 1.

FIG. 2 is a front view of the slotted face 17 of a typical slotted waveguide radiator such as the waveguide radiator 16C of FIG. 1. The energy is coupled into the interior of the waveguide from the associated coaxial cables and isolators through the back wall of the waveguide by means of probes indicated at 82 and 84. These probes extend into the interior of the waveguide typically to a dimension equivalent to at least one-half of the depth of the waveguide, and they are preferably spaced from the adjacent end wall by one quarter of a wavelength so that energy directed to the end wall is reflected in phase with energy directly radiated down the waveguide toward the other end wall. The end wall members 86 and 88 may be advantageously designed to be initially adjustable in and out of the end of the waveguide during fabrication so as to optimize the energy transfer from the probe to the interior of the waveguide by fine adjustment of the spacing between the probe and the end wall.

As illustrated, the slots H-A and B1-H1 are preferably staggered or alternated on opposite sides of the longitudinal center line 90 of the waveguide, the slot having the largest displacement from the center line (and thus the greatest coupling of energy out of the waveguide) being the slot A which is located at the transverse center line 92 of the waveguide. The slots have progressively smaller displacements from the center line 90 the farther the slots are positioned from the transverse center line 92. The center-to-center distances from slot to slot, such as from slot A to slot B and from slot B to slot C are uniform for a particular waveguide. This center-to-center distance between slots is the chief factor which determines the squint angle. This condition applies because the radiated frequency is held constant within narrow limits. Increasing the center-to-center slot spacing moves the beam away from the feed end of the waveguide radiator, and shortening the spacing moves the beam toward the feed end of the waveguide radiator.

The dimensions and spacings of the slots are preferably determined in accordance with the teachings available in the literature on the subject. For instance, attention is directed to chapters 2 and 9 of the *Antenna Engineering Handbook* edited by Henry Jasik and published in 1961 by McGraw-Hill Book Company of New York. Pages 9–5 through 9–18 are particularly pertinent. Slots of the type illustrated in FIG. 1 are referred to in the textbook as longitudinal shunt slots. As taught in the textbook, the number and spacing and arrangement of the slots not only determine the "squint" angle, but also the width and shape of the beam radiated by the waveguide. The textbook sections referred to above do not deal with the concept of driving the slotted waveguide from either end. Rather, the treatment contemplates driving the waveguide from only one end. When the waveguide is driven from only one end, the best arrangement of the slots is not symmetrical about the transverse center line 92, although the general arrangement of the slots with the wider offsets of slots appearing near the transverse center line 92 is applicable.

In carrying out the present invention, where it is desired to drive the waveguide from either end, it has been determined that it is desirable to make the waveguide slotted face symmetrical about the transverse center line 92. Thus, slot B1 has the same size, and the same displacement from the longitudinal axis 90 as does slot B. Slot C1 has the same size and displacement as slot C etc. It has been found to be quite effective to follow the design criteria set forth in the above mentioned textbook to determine the best size and displacement dimensions for the slots (H-B and A) in the driven end of the waveguide, and to make the slots (B1-H1) in the non-driven end symmetrical in size and spacing to those in the driven end. Stated another way, when the waveguide 16 is driven from the left end by a signal on probe 82, the slots H-A present the best textbook design for the production of the desired wave, and the remaining slots B1-H1 represent a slight compromise in sizes and spacings, but the compromise does not impair performance seriously. On the other hand, when the waveguide is driven from the right end by a signal on probe 84, the slots H1-B1,A present the ideal design parameters, while the slots B-H on the non-driven end represent a compromise. One result of this compromise is that a small additional amount of residual power must be absorbed in the isolators.

The invention also contemplates the possibility that there may be two "center" slots A and A1 equally spaced on opposite sides of the transverse center line 92, and equally spaced on opposite sides of the longitudinal center line 90, without any interruption in the staggered or alternating arrangement of the slots on opposite sides of the longitudinal center line 90. The term "symmetrical" as used in describing the arrangements of slots in accordance with this invention is intended to include such an arrangement, even though it does not represent perfect symmetry on the two sides of the lateral center line 92, as the term is usually employed. However, the symmetry does exist in that the A and A1 slots are of equal size and are at equal offset distances from the longitudinal center line, as are all of the other complementarily identified slots B-B1, C-C1, etc.

In a particular preferred physical embodiment the waveguide radiators are designed for operation at 5,002 MHz (actually intended to be operated in the range from 5,000 to 5,004 MHz), and employ a standard rectangular cross-section waveguide WR-187 having normal inside dimensions of 2.215 cm. by 4.755 cm. The slots are cut to a uniform nominal width of 2.4 mm. While only fifteen slots are illustrated in FIG. 2, a typical waveguide for a narrow beam may employ seventeen or nineteen slots. The typical dimension from the inside surface of the end of the waveguide to the center line of the adjacent end-most slot is equal to twice the center-to-center slot spacing.

Referring back again to FIG. 1, the waveguides 16A and 16D each include an additional means for providing a linear phase progression in the signal components radiated from the slots from one end of the waveguide to the other to thereby provide an angular tilt to each radiated beam which is independent of the direction in which energy is fed to the waveguide. In this embodiment, this means consists of a horn structure 94, 94A which is provided around the slotted face 17 of each of the waveguides 16A, 16D. As shown in the drawing, just inside the outer terminal edge of each horn structure 94, 94A there is provided a dielectric prism 104, 104A which is cemented, or otherwise fastened within the outer portion of the horn 94, 94A. The dielectric prism 104, 104A serves to impart the phase progression angular tilt to the beams. The terminal edges of the horn structure 94, 94A and the outer surface of the prism 104, 104A define the effective radiation aperture of each of these radiation elements. In a particular preferred physical embodiment, the phase progression tilt angle is 1.35°.

The longitudinal slot spacing of the slots within the slotted face of the waveguide 16A is selected to provide a squint angle of 3.15°. Since the direction of the squint deflection of the beam away from the direction normal to the face of the waveguide is dependent upon the direction in which the waveguide is driven, but the phase progression angular tilt is independent of the direction in which the waveguide is driven, the two angles must be algebraically combined to provide the resultant beam angle.

In the following discussion, the direction normal to the aperture face of the waveguide is taken as zero degrees, with angles of clockwise deflection being taken as positive angles, and angles of counterclockwise deflection as negative angles. When the waveguide 16A is driven from the left end by microwave energy on connection 50 through isolator 66, the backward squint of minus 3.15° is combined with the phase progression angular tilt of plus 1.35° to produce a net beam angle of minus 1.8° for beam 144. When waveguide 16A is driven from the other end by microwave energy on connection 52 through isolator 68, the backward squint angle of plus 3.15° is combined with the phase progression tilt angle of plus 1.35° to provide a net beam angle of plus 4.5° for the beam 148.

Waveguide 16D is of a construction identical to waveguide 16A, with the exception that it is turned around to provide a negative phase progression angular tilt to the radiated beams. Thus, the backward squint of minus 3.15° for beam 142 is algebraically added to the phase progression tilt of minus 1.35° to provide a net angle of minus 4.5° for that beam. For beam 146, the backward squint of plus 3.15° is algebraically added to the phase progression angular tilt of minus 1.35° to provide a net angle of plus 1.8° for that beam.

The advantages of combining the phase progression angular tilt and the squint angle in each of the waveguide radiators 16A and 16D to provide the net beam angles are quite important. While not necessarily the most important advantage, it is obvious that the structures of the two waveguide radiators 16A and 16D may be substantially identical, providing greater standardization and greater economy in the production of these structures. It is only necessary to assemble the two waveguides in opposite sense in the array in order to provide the desired complementary phase progression angular tilts. Two other advantages are even more important, however. These are the reduction in parallax error, and the increase in the avoidance of interference by a space diversity effect as the different beams are radiated.

The parallax error in an antenna array such as that illustrated in FIG. 1 arises from the fact that the center lines of all of the radiating elements 16A–16D should exactly coincide with the guidance plane which is being established by the signals. Obviously the center lines of the radiating elements cannot all coincide with the guidance plane since, for vertical focusing and shaping of the beams, the elements must be positioned along a common line of radiation. However, in the configuration according to the present invention, the beams 142, 144, 146, and 148, which are nearest the zero angle of the guidance path plane, and which thus are most influential in defining the exact position of the guidance path plane for an aircraft which is on course, are actually symmetrically arranged with respect to the entire antenna array. Thus, beams 144 and 146, constitute a pair of beams which are each within 1.8° of the guidance plane, and these two beams are arranged in symmetrically balanced positions at opposite ends of the antenna array, each of these beams being directed outwardly at an angle of 1.8° . Similarly, the two beams 142 and 148 at the 4.5° positions also constitute a pair of beams each angularly displaced from the guidance plane by 4.5°. Again, these beams are arranged symmetrically with respect to the entire antenna array, each of said beams being aimed inwardly at 4.5°. These beams, as reflected, ultimately cross and diverge. It does not really matter that the 4.5° beam pair 142 and 148 initially converge, whereas the 1.8° pair of beams 144 and 146 initially diverge. The important factor is that these pairs of beams are issued in a symmetrical fashion about a common plane of symmetry, which is midway between the waveguides 16A and 16D. As will be seen, this common symmetry plane is close to the actual centers of radiation for the other radiating elements 16B and 16C. Accordingly, the parallax error is substantially eliminated with respect to the central four beams 142, 144, 146, and 148, and is substantially reduced for the entire array.

The increase in the avoidance of interference by a space diversity effect as the different beams are radiated is accomplished because the beams are energized (or illuminated) in a sequence. Preferably, the sequence is arranged so that there is an alternation in the illumination of beams at the opposite ends of the array from the radiation elements 16A and 16D. By providing such an alternation in illumination, any near field obstructions to the signals which tend to cause signal distortions have substantially different effects on the beams emitted from the two different radiating elements 16A and 16D by reason of the different initial radiating positions. The different distortions appear to an aircraft receiver to come from different bearing angles, and thus do not reinforce one another. Thus, there is a space diversity effect which tends to minimize the disturbances to the signals as received by an aircraft receiver.

It will be understood that the specific angles for the squint, and for the phase progression angular tilt are given here by way of illustration only, and that various other combinations of angles may be employed, depending upon what angle of tilt is desired for the related beams. It is generally important, however, particularly where the radiation elements are employed in an array such as illustrated in FIG. 1, that the opposite members of related pairs of beams should be radiated from the elements at opposite ends of the array. Thus, the related beams 144 and 146, which are both at 1.8°, are radiated from different radiation elements 16A and 16D at the opposite ends of the array.

It will also be understood that additional pairs of the slotted waveguide radiators including means for imparting a linear phase progression angular tilt may be employed to produce additional beams within an array similar to that of FIG. 1.

Figure 3:
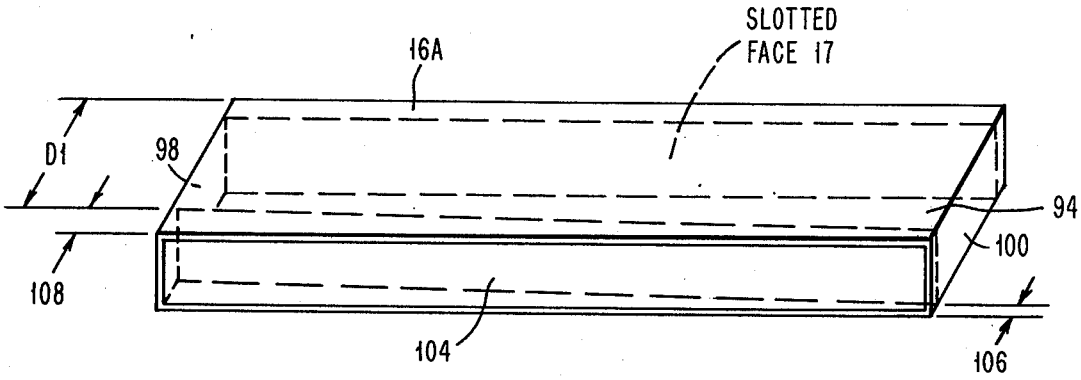
FIG. 3 illustrates in more detail the exact construction of one preferred embodiment of a radiating element including the linear phase progression angular tilt feature.

FIG. 3 illustrates, in perspective, a more detailed view of the slotted waveguide radiating element 16A including the horn structure 94 having the dielectric prism 104 for providing the phase progression angular tilt. The longitudinal ends of the horn structure 94 are also preferably closed, as indicated at 98 and 100.

It is desirable that the minimum depth D1 of the horn should be in the order of two wavelengths of the frequency which is being handled. Accordingly, relating the disclosure to a specific example, assuming a frequency of about 5,000 MHz, the minimum horn depth should be about twelve centimeters to equal two wavelengths.

Relating further to the specific example given above, for a squint angle of 3.15°, the center-to-center longitudinal spacing between adjacent slots is about 4.118 centimeters, assuming a nominal operating frequency of 5,002 MHz. With a slotted waveguide radiator having 17 slots, this requires a total length of the slotted waveguide of 82.268 centimeters. Since the inside width of the waveguide is only 4.755 centimeters, the proportions of the actual physical embodiment for which dimensions are given above are substantially different than shown in FIG. 3. That is, the actual proportions are much longer and narrower.

The dielectric prism 104 not only serves the useful purpose of imparting a phase progression angular tilt to the beams, but also serves to close up the horn for physical protection thereof, thus preventing foreign objects from getting into the horn and the waveguide which may interfere with proper operation thereof. As indicated by the dimensions at 106 and 108 in the drawing, the dielectric prism 104 is necessarily wedge-shaped, and has a greater thickness 108 at the left end than the thickness 106 at the right end in the drawing. The phase progression angular tilt is not only a function of these dimensions, but is also a function of the dielectric constant of the dielectric material. Various different dielectric materials may be used for this purpose, the main requirements being consistent and stable physical and electrical properties. Suitable materials include for instance polystyrene and styrene copolymers, which are sometimes referred to as cross linked polystyrene. The dielectric constant for these materials is about 2.55. However, many other synthetic resin materials are also useful for this purpose. The significance of the difference between the minimum thickness 106 of the prism 104 and the maximum thickness 108 is explained below, and is more easily understood after the following explanation of the embodiment of FIG. 4.

Figure 4:
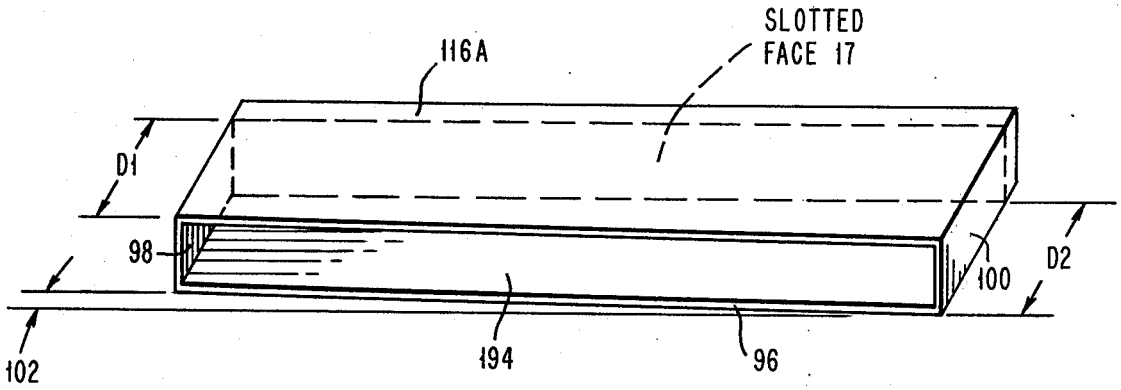
FIG. 4 illustrates a modification of the embodiment of FIG. 3, including the linear phase progression angular tilt feature.

FIG. 4 illustrates a modification of the structure of FIG. 3 wherein the phase progression angular tilt means employs a horn structure 194 having a slanted or tapered terminal edge 96 for providing the phase progression angular tilt. Again, the longitudinal ends of the horn structure 194 are also preferably closed, as indicated at 98 and 100.

The angle of taper of the terminal edge 96 of the horn structure 194 is indicated at 102. This is the angle which the terminal edge 96 makes with a plane which is parallel to the slotted face 17 of the slotted waveguide radiating element 116A. In the open horn structure of FIG. 4, this taper angle indicated at 102 is equal to the tilt angle imparted to each beam by reason of the phase progression. Thus, in the example given, this angle is equal to 1.35°. The angle is exaggerated in the drawing in order to promote clarity. Another way of relating the phase progression angular tilt to the physical structure of the horn 94 is to state that the angle of tilt is an angle whose trigonometric tangent is equal to D2 minus D1 divided by L, where D2 is the depth of the deepest end of the horn, and D1 is the depth of the shallowest end of the horn, as indicated in the drawing, and where L is the longitudinal length of the waveguide and horn. The terminal edge 96 of the horn structure 194 defines the radiation aperture for this embodiment.

In FIG. 3, the difference between the minimum thickness 106 of the prism 104 and the maximum thickness 108 is determined in a manner similar to the difference between the dimensions D1 and D2 in the embodiment of FIG. 4 but is modified by dividing the difference by the square root of the dielectric constant.

Thus, with a dielectric constant of 2.55, the difference in the two dimensions 106 and 108 is 0.625 times the difference between the two dimensions D1 and D2 of FIG. 4. Since the difference between D1 and D2 in FIG. 3 was 1.94 cm., that value multiplied by the factor 0.625 yields a difference of 1.2125 centimeters between the dimensions 106 and 108 in FIG. 3 for the phase progression angular tilt of 1.35°.

While the two arrangements illustrated in FIGS. 3 and 4 are the preferred arrangements for providing the phase progression angular tilt, still other means may be provided, if desired. For instance, the phase progression angular tilt may be imparted by providing a progressive increase in the center-to-center spacings of the loading slots from one end of the waveguide to the other. In such an arrangement, the average center-to-center spacing is determined according to the desired squint angle which is to be produced. This modification avoids the need for adding horn structures to the waveguides.

Figure 5:
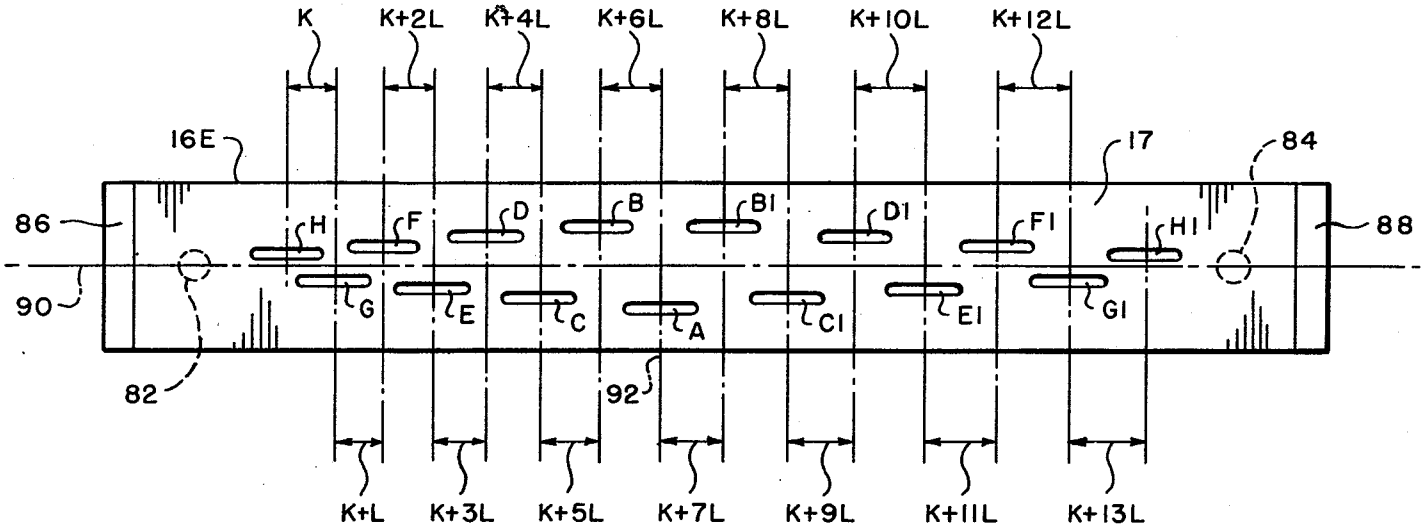
FIG. 5 illustrates the construction of another embodiment of a radiating element including the linear phase shift progression angular tilt feature.

FIG. 5 illustrates the modification last mentioned in the preceding paragraph. FIG. 5 is a face view of the slotted face of a waveguide radiator 16E, corresponding to the view previously shown in FIG. 2, but modified by the feature that the center-to-center spacings of the loading slots from one end of the waveguide to the other increase progressively in a linear dimensional fashion. Thus, as illustrated in the drawing, the center-to-center spacing from slot H to slot G is a dimension K. The center-to-center spacing from slot G to slot F is the dimension K plus the increment L. The center-to-center spacing from slot F to slot E is the dimension K plus the increment 2L. Thus, the center-to-center spacings from slot to slot increase by the fixed increment L in a progressive manner from slot H to the other end of the radiator at slot H1. The incremental increase L in slot spacing is quite small and has been exaggerated in the drawing in order to provide a graphic representation of the principle of this embodiment of the invention.

While the invention has been disclosed in conjunction with a guidance system employing signal beams modulated with conventional 90 and 150 Hz frequencies, it is obvious that the principles of the invention may be directly employed in other commutated beam systems.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. A line source microwave radiation element for feeding a reflector for radiating two shaped beams at selected angles comprising a slotted waveguide arranged to receive signal inputs at either end and having loading slots arranged in the face of one wall thereof and spaced transversely with respect to the longitudinal axial center line thereof to produce beams of a desired shape within a central plane containing said axial center line, said loading slots having predetermined center-to-center spacings in the longitudinal dimension to provide a predetermined squint angle within said central plane for each radiated beam with respect to the plane of said slotted face and related to the direction in which energy is fed to the waveguide, and means for providing a linear phase shift progression in the signal components radiated from the slots from one end of said waveguide to the other to thereby provide a predetermined angular tilt to each radiated beam within said central plane which is independent of the direction in which energy is fed to the waveguide and which is algebraically added to said squint angle.

2. A device as claimed in claim 1 wherein said phase shift progression means comprises a progressive increase in said predetermined center-to-center spacings of said loading slots from one end of said waveguide to the other.

3. A device as claimed in claim 1 wherein said phase shift progression means comprises at least one beam phase modification element arranged in the beam radiation field in front of said slotted face, said beam phase modification element extending across the entire length of said waveguide and having a physical dimension which is tapered from one end of said waveguide to the other.

4. A device as claimed in claim 3 wherein said beam phase modification element comprises a wedge of dielectric material.

5. A device as claimed in claim 3 wherein said beam phase modification element comprises a pair of conductive plates arranged on opposite sides of said slotted face of said waveguide to form a horn structure, the outer edges of said conductive plates having a dimension to said slotted face which is tapered from one end of said waveguide to the other.

6. An antenna array for feeding a reflector for radiating a pattern of angularly spaced microwave radio beams which are particularly useful for instrument guidance of aircraft comprising a first pair of slotted waveguide microwave signal radiating elements, each of said elements having loading slots in the face of one wall thereof and spaced transversely with respect to the longitudinal axial center line thereof to produce beams of a desired shape within a central plane containing said axial center line, said antenna array being operable as a switched scanning beam antenna array in which carrier energy is switched in a sequence from one beam to another, said radiating elements each including means for separately introducing signals at each end thereof, each of said radiating elements being designed with the positions of the slots in the slotted wall thereof arranged so as to provide radiation directed outwardly at predetermined angles referred to as squint angles of deviation away from a direction normal to the slotted face of the radiating element, said squint angles being dependent upon the direction of propagation of the signal through the waveguide so that oppositely disposed squint angles are provided when the radiation element is fed from opposite ends, said radiating elements being arranged end to end with the radiation apertures formed by said radiating elements being in mutual alignment and being mutually parallel so that the central plane of the individual beams produced by each of said radiating elements is a common central plane, said radiating elements of said first pair having equal squint angles, each of said radiating elements of said first pair including means for providing a linear phase shift progression in the signal components radiated from the slots from one end of said element to the other to thereby provide a predetermined angular tilt to each beam within said central plane which is independent of the direction in which energy is fed to the element and which is algebraically added to the applicable squint angle, the phase shift progression angular tilt for one of said radiating elements of said first pair being opposite to the phase shift progression angular tilt for the other one of said radiating elements of said first pair and the combinations of squint angles and phase shift progression angular tilts being selected to provide four beams from said radiating elements which are at four different selected angles within said central plane.

7. An antenna array as claimed in claim 6 wherein the reflector comprises means for shaping said beams produced by said array in the dimension transverse to said common central plane of said radiated beams.

8. An antenna array as claimed in claim 7 wherein said transverse beam shaping means comprises a cylindrical reflector positioned and arranged such that the parallel cylinder generation element lines thereof are substantially parallel to said common longitudinal axial center line, and said cylindrical reflector is shaped to provide common radiation patterns in the dimension transverse to said common central plane.

9. An antenna array as claimed in claim 6 wherein there is provided a second pair of slotted waveguide microwave signal radiating elements having all of the features of said first pair and arranged end to end with the members of said first pair with said apertures of said radiating elements being in mutual alignment and mutually parallel so that the central plane of the individual beams produced by each of said radiating elements of said first and second pairs is a common central plane, said radiating elements of said second pair having equal squint angles different from the squint angles of said first pair, said means for providing a linear phase shift progression angular tilt in said second pair of radiating elements being operable to provide an angular tilt different from the angular tilt provided in said first pair, and the combinations of squint angles and phase shift progression angular tilts for said second pair being selected to provide four beams from said radiating elements of said second pair which are at four different selected angles within said central plane which are different from the four beam angles provided from said first pair to provide a total of eight different beam angles from said two pairs.

10. An antenna array as claimed in claim 6 wherein a plurality of slotted waveguide microwave signal radiating elements are provided in addition to said first pair of radiating elements, each of said additional radiating elements having loading slots in the face of one wall thereof and spaced transversely with respect to the longitudinal axial center line thereof to produce beams of a desired shape within a central plane containing said axial center line, each of said additional radiating elements being designed with the positions of the slots in the slotted wall thereof arranged so as to provide radiation directed outwardly at predetermined angles referred to as squint angles of deviation away from a direction normal to the slotted face of the radiating element, said squint angles being dependent upon the direction of propagation of the signal through the waveguide so that oppositely disposed squint angles are provided when the radiation element is fed from opposite ends, and said additional radiating elements being arranged end-to-end with said first pair of radiating elements with said longitudinal axial center lines of all of said radiating elements being in a common central plane and with the radiation apertures of all of said radiating elements being mutually parallel and perpendicular to said common central plane so that the central plane of the individual beams produced by each of said radiating elements is in said common central plane.

11. An array as claimed in claim 10 wherein said additional radiating elements each include means for separately introducing signals at each end thereof to provide a separate beam from each radiating element for signals introduced at each end respectively.

12. An antenna array as claimed in claim 10 wherein the members of said first pair of radiating elements incorporating the phase shift progression angular tilt are positioned at opposite ends of said array.

13. An antenna array as claimed in claim 12 wherein said radiating elements incorporating said means for providing the phase shift progression angular tilt are designed to produce the four beams at the center of the group of beams produced by said array.

14. An array as claimed in claim 6 wherein said phase shift progression means for each of said radiating elements comprises at least one beam phase modification element arranged in the beam radiation field in front of said slotted face, said beam phase modification element extending across the entire length of said element and having a physical dimension which is tapered from one end of said element to the other.

15. A device as claimed in claim 14 wherein said beam phase modification element comprises a wedge of dielectric material.

16. A device as claimed in claim 14 wherein said beam phase modification element comprises a pair of conductive plates arranged on opposite sides of said slotted face of said element to form a horn structure, the outer edges of said conductive plates having a dimension to said slotted face which is tapered from one end of said element to the other.

17. An antenna array as claimed in claim 6 wherein said means for separately introducing signals at each end of each slotted waveguide includes an isolator operable to pass the signal into the associated end of the waveguide but operable to act as a non-reflective load for any signal propagated from the opposite end of the waveguide.

18. An antenna array as claimed in claim 6 wherein the slots in said slotted waveguide microwave signal radiating elements comprise longitudinal shunt slots.

19. An antenna array as claimed in claim 18 wherein each of said slotted waveguide microwave signal radiating elements includes a plurality of slots arranged at various laterally offset spacings from the longitudinal axis of the waveguide, the slot having the largest lateral offset spacing being located nearest the lateral center line of the waveguide, and the slots having progressively reduced offset spacings at successive positions progressing from the lateral center line toward each end of the waveguide.

20. An antenna array as claimed in claim 19 wherein the slots of said slotted waveguide microwave signal radiating elements are staggered on opposite sides of the longitudinal center line of the slotted face of each waveguide.

21. An antenna array as claimed in claim 20 wherein the pattern of slots is symmetrical about the transverse center line of each slotted waveguide.

22. An antenna array as claimed in claim 21 wherein the slots on each side of the transverse center line of each slotted waveguide are positioned and dimensioned for optimum performance in coupling energy introduced at the end of the associated side of the waveguide.

23. A method of radiating two shaped beams of microwave energy to a reflector from a single slotted waveguide at different selected angles in relation to a direction normal to the waveguide comprising the steps of positioning the loading slots in the slotted face of the waveguide with predetermined center-to-center spacings in the longitudinal dimension to provide a predetermined squint angle for the radiated beams related to the direction in which energy is fed to the waveguide, providing a linear phase shift progression in the signal components radiated from the slots from one end of the waveguide to the other to thereby provide a predetermined angular tilt to each radiated beam which is independent of the direction in which energy is fed to the waveguide, and then introducing microwave energy to the opposite ends of the waveguide in sequence to provide separately directed beams in response to the energy introduced to the respective ends of the waveguide.

* * * * *